US006921443B1

(12) United States Patent
Starcevic

(10) Patent No.: US 6,921,443 B1
(45) Date of Patent: Jul. 26, 2005

(54) PROCESS FOR PRODUCING STAINLESS STEEL WITH IMPROVED SURFACE PROPERTIES

(75) Inventor: Jovan Starcevic, Vienna (AT)

(73) Assignee: Andritz AG, Graz (AT)

( * ) Notice: Subject to any disclaimer, the term of this patent is extended or adjusted under 35 U.S.C. 154(b) by 552 days.

(21) Appl. No.: 09/714,670

(22) Filed: Nov. 17, 2000

(30) Foreign Application Priority Data

Nov. 18, 1999 (AT) ..... 1949/99

(51) Int. Cl.[7] ..... C25F 1/06

(52) U.S. Cl. ..... 148/518; 148/606; 205/704; 205/723

(58) Field of Search ..... 148/518, 606, 148/636; 205/704, 705, 723

(56) References Cited

U.S. PATENT DOCUMENTS

| | | | | |
|---|---|---|---|---|
| 4,201,650 A | | 5/1980 | Nagano et al. | 204/209 |
| 4,363,709 A | * | 12/1982 | Zaremski | 205/712 |
| 4,391,685 A | | 7/1983 | Shepard et al. | 204/145 R |
| 4,450,058 A | * | 5/1984 | Lovejoy | 205/714 |
| 4,713,154 A | | 12/1987 | Ohta et al. | 204/145 R |
| 4,851,092 A | | 7/1989 | Maresch | 204/145 R |
| 4,859,297 A | | 8/1989 | I et al. | 204/145 R |
| 5,248,372 A | | 9/1993 | McNamee | 156/345 |
| 5,786,556 A | | 7/1998 | Gronlund et al. | 205/705 |
| 5,804,056 A | | 9/1998 | Pempera et al. | 205/661 |
| 5,820,704 A | | 10/1998 | Veyer et al. | 148/610 |
| 5,830,291 A | | 11/1998 | McGuire et al. | 148/610 |
| 5,843,240 A | | 12/1998 | Pedrazzini et al. | 134/3 |
| 5,879,465 A | | 3/1999 | McKevitt et al. | 134/3 |
| 5,904,204 A | | 5/1999 | Teraoka et al. | 164/417 |

FOREIGN PATENT DOCUMENTS

JP 63-86899 * 4/1988

OTHER PUBLICATIONS

McGraw Hill Dictionary of Science and Engineering, Parker, Sybil P. ed.–in–chief, McGraw Hill Inc., 1984, p. 119.*

Handbook of Metal Treatments and Testing, Ross, Robert B., E. & F.N. Spon Ltd, 1977, p. 173.*

* cited by examiner

*Primary Examiner*—George Wyszomierski
(74) *Attorney, Agent, or Firm*—Roylance, Abrams, Berdo & Goodman, L.L.P.

(57) ABSTRACT

A process for treating a stainless steel strip in an electrolytic tank produces a stainless steel with improved surface properties. The process subjects the stainless steel to a bright annealing process, followed by an electro-chemical treatment stage at current densities of up to 200 A/dm$^2$. The electro-chemical treatment is typically in a sulfate containing electrolyte solution. The current density can range from about 20 A/dm$^2$ to about 200 A/dm$^2$.

32 Claims, 4 Drawing Sheets

PROCESS FOR PRODUCING STAINLESS STEEL WITH IMPROVED SURFACE PROPERTIES

FIELD OF THE INVENTION

The present invention is directed to a process for producing a stainless steel article with improved surface properties. More particularly, the invention is directed to a process for treating a bright annealed stainless steel strip by an electrolytic cleaning step.

BACKGROUND OF THE INVENTION

In the manufacture of flat-rolled stainless sheets, it is necessary to anneal or soften the material for further cold-rolling operations. It is also necessary to anneal the material at the finish gauge to render it suitable for fabrication by stamping, forming, and the like. Annealing is necessary because cold rolling elongates the grains of the stainless steel, greatly distorts the crystal lattice, and induces heavy internal stresses. The steel that results from the cold rolling process is typically very hard and has little ductility. The annealing process allows the cold-worked steel to recrystallize, and if the steel is held at the proper annealing temperature for a sufficient time, the structure of the annealed steel will again consist of undistorted lattices and the steel will again be soft and ductile.

The continuous annealing process involves unwinding the coil from a payoff reel and continuously feeding the coil into and pulling the coil through a furnace and then rewinding the coil on a take-up reel. The furnace is typically electric or gas fired. The steel strip, while traveling in the furnace, is typically heated to a temperature in the range of about 1000° C. to about 1200° C. in the case of austenitic alloys and to a temperature in the range of about 750° C. to about 1000° C. for ferritic alloys. The annealing temperatures vary depending upon the particular alloy being annealed, as well as the intended end-use of the alloy.

A bright-annealing plant basically comprises a bright-annealing furnace, preceded by a degreasing unit. The furnace is operated with a hydrogen atmosphere so that the stainless steel strip does not oxidize at the high annealing temperatures. There are, however, trace amounts of moisture and oxygen in the hydrogen atmosphere of the furnace. Depending on the level of the dew point in the furnace, oxide layers can form on the stainless steel strip. In particular, during start-up of the furnace there may be higher concentrations of oxygen, causing such extensive oxide formation that the oxides become visible on the surface of the stainless steel in the form of annealing colors. In order to eliminate these problems, many bright-annealing plants are equipped with an electro-chemical nitric acid treatment stage in the discharge section of the annealing furnace. It is not possible, however, to quantify exactly the success of this treatment. Sometimes the stainless steel strip shows even stronger annealing colors after the nitric acid electro-chemical treatment. In fact, most new bright-annealing plants are planned and built without this nitric acid electro-chemical post-treatment stage. This is primarily due to the fact that the annealing furnace atmosphere can be controlled much more effectively and the dew point no longer fluctuates to the same extent as before.

The advantage of a bright-annealing plant is that the surface qualities that can be obtained provide very high brightness and very low roughness levels. Compared with a cold-rolled stainless steel strip from a conventional plant which is annealed and pickled, the stainless steel material produced from the bright-annealing plant has the disadvantage of having a different surface composition. The surface composition of the surface scale is a disadvantage in the subsequent mechanical processing stages, such as tension-leveling, skin-pass rolling, punching, and deep-drawing.

The surface scale of the bright annealed stainless steel can often cause considerable difficulties if it is run through the stretcher-and-roller leveling machine that is used to improve flatness. Surface material from the strip can be deposited and form a coating on the rollers. In addition, micro-cracks can form in the strip surface which have an adverse effect on the brightness of the stainless steel. The hard particles on the surface of the bright annealed material lead to much shorter work roller service life in the skin-pass mill.

The surface scale on the bright annealed stainless steel also result in shorter tool service life of cutting and deep-drawing machinery. In addition, the modern cutting presses which operate at up to 1000 cuts per minute often cannot achieve full productivity with the bright annealed material. In the deep-drawing process the precision is often lacking if the material has different friction coefficients on the surface.

In recent years, improvements in bright annealing plants are the result of the introduction of 100% hydrogen atmosphere, high convection devices, improved furnace design, and modern computer controls. These improvements in the batch annealing technology have resulted in an increase of energy efficiency and improvement of heat transfer rates during both heating and cooling periods, thereby producing more uniform properties throughout the coil and reducing the process cycle time by more than 50% over older batch annealing operations. These improvements, together with alternative impeller materials, have resulted in maximum temperatures attainable in commercially available annealing furnaces of approximately 900° C. or more.

Accordingly, there is a continuing need in the industry for an improved process for treating stainless steel.

SUMMARY OF THE INVENTION

The present invention is directed to a process for producing a stainless steel article having improved surface properties. More particularly, the invention is directed to a process of treating the surface of a bright annealed stainless steel article by an electrolytic cleaning step to remove scale and other impurities from the surface.

Accordingly, a primary object of the invention is to provide a process for treating a bright annealed stainless steel article to improve the machine working properties of the article.

Another object of the invention is to provide a process for treating a bright annealed stainless steel article to improve the surface properties of the article for extending the tool life of the machine tools.

A further object of the invention is to provide a process for removing scale from the surface of a bright annealed stainless steel article to improve the surface brightness of the article.

Still another object of the invention is to provide a process for electrolytically removing scale from the surface of a bright annealed stainless steel strip material at a high current density to enhance the cleaning effect and improve the surface brightness of the stainless steel strip.

Another object of the invention is to provide a process for electrolytically cleaning and removing scale from a bright annealed stainless steel article in an electrolyte solution at a current density of up to about 200 $A/dm^2$.

Another object of the invention is to provide a process for electrolytically cleaning and removing scale from a bright annealed stainless steel strip in an electrolyte solution at a current density of about 20 to about 200 A/dm$^2$.

A further object of the invention is to provide a process for electrolytically cleaning a bright annealed stainless steel strip material in a sulfate electrolyte at a pH of about pH 4 to about pH 12.

A further object of the invention is to provide a process for enhancing the brightness of a bright annealed stainless steel strip material by treating the strip material in a sodium sulfate electrolyte at pH 7 to about pH 14 and at a temperature of about 30° C. to about 95° C.

Still another object of the invention is to provide a process for cleaning and removing the scale from a bright annealed stainless steel strip material by treating the strip material in a sodium sulfate electrolyte solution at a charge density of about 100 to about 3000 C/dm$^2$.

Another object of the invention is to provide a process for cleaning and removing scale from the surface of a bright annealed stainless steel strip in a sulfuric acid electrolyte having a free acid concentration of at least 5 g/l and a redox potential of approximately 860 mV.

Another object of the invention is to provide a process for cleaning and removing scale from the surface of a bright annealed stainless steel strip in a sulfuric acid electrolyte solution containing a reducing agent or oxidizing agent.

A further object of the invention is to provide a process for cleaning and removing scale from a surface of a bright annealed stainless steel surface in a sulfuric acid electrolyte solution at a charge density of about 100 to about 3000 C/dm$^2$.

Another object of the invention is to provide a process for cleaning and removing scale from the surface of a bright annealed stainless steel strip material in a sulfuric acid electrolyte at a current density of about 5 to about 100 A/dm$^2$.

The objects and advantages of the invention are basically attained by providing a process for producing a stainless steel article having improved surface properties, comprising the steps of: annealing a stainless steel article at a temperature and for sufficient time to produce a bright annealed finish on the article; and thereafter treating the stainless steel article in an electrolyte solution and applying an electric current to the electrolyte solution at a current density of up to about 200 A/dm$^2$.

The objects of the invention are further attained by providing a process of producing a stainless steel article having improved surface properties. The process comprises the steps of: annealing a stainless steel article at a temperature and for sufficient time to produce a bright annealed surface on the article; and thereafter electro-chemically treating the article in a sulfuric acid electrolyte solution at a current density of up to about 200 A/dm$^2$.

The objects of the invention are still further attained by providing a process for producing a stainless steel article comprising: annealing a stainless steel article at a temperature and for a time to produce a bright annealed surface on the article; and thereafter electro-chemically treating the bright annealed surface in a sodium sulfate electrolyte by applying an electric current at a current density of about 20 A/dm$^2$ to about 200 A/dm$^2$ and charge density of about 100 C/dm$^2$ to about 3000 C/dm$^2$.

The objects, advantages and other salient features of the invention will become apparent from the following detailed description of the invention and the annexed drawings which form a part of this original disclosure.

BRIEF DESCRIPTION OF THE DRAWINGS

The following is a brief description of the drawings in which.

DETAILED DESCRIPTION OF THE INVENTION

Figure 1A:
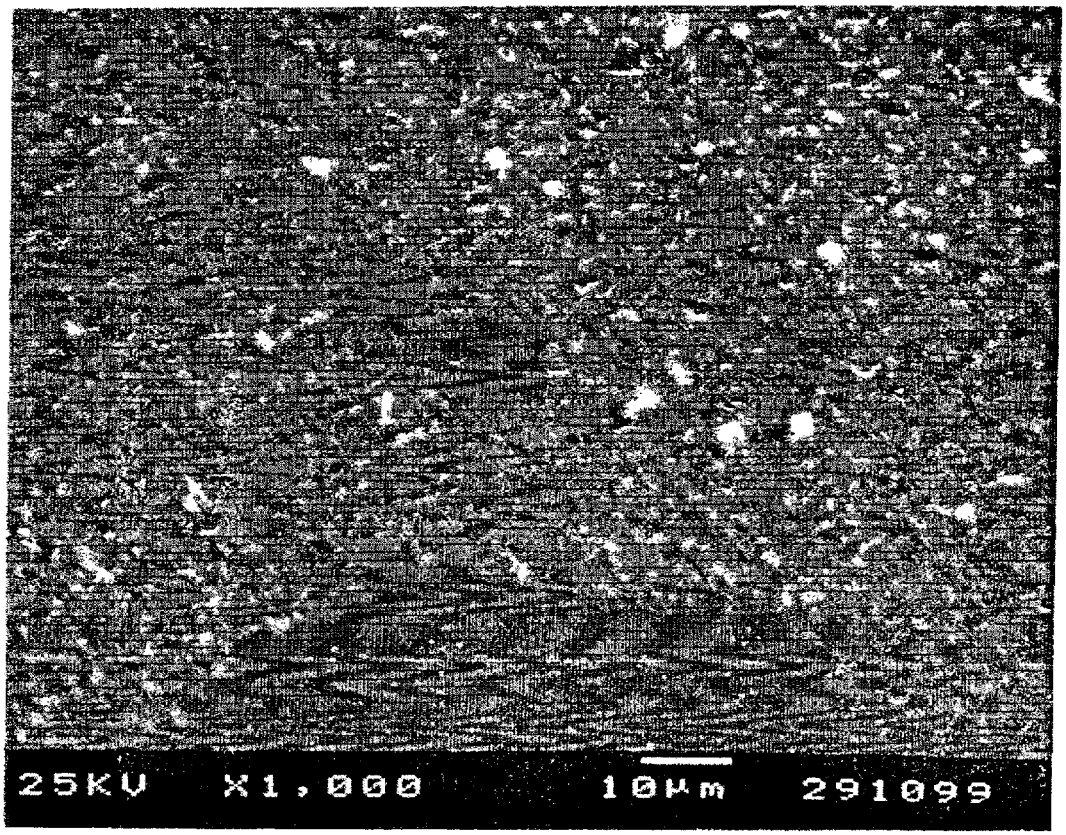
FIG. 1*a* is a surface electron microscope image of a bright annealed stainless steel article before treatment in accordance with one embodiment of the invention.

The present invention is directed to a process for improving the surface properties of a bright annealed stainless steel article. More particularly, the invention is directed to an electrolytic cleaning step for treating the surface of a bright annealed stainless steel article to remove scale and other materials from the surface of the stainless steel.

The process of the invention is primarily directed to treating the surface of a stainless steel strip material or other article that has been annealed in an annealing oven. The process of the invention is particularly suitable for treating a bright annealed stainless strip material that has been annealed in a hydrogen atmosphere or other inert atmosphere at a temperature of about 800° C. to about 1100° C. The bright annealed stainless steel article is produced according to standard procedures as known in the art. After the annealing step, the bright annealed stainless steel strip includes a layer of scale and other hard materials that interfere with the subsequent machining of the stainless steel strip. The scale includes impurities, such as oxides, carbides, sulfur compounds and boron compounds. The process of the invention is effective in removing the scale and other materials from the surface of the bright annealed stainless steel strip material to improve the brightness and machining properties of the steel. As used herein the bright annealed stainless steel refers to stainless steel that has been annealed in an inert atmosphere and preferably a hydrogen atmosphere.

In one process of the invention, a continuous strip of stainless steel is passed through an annealing furnace in a hydrogen or other inert atmosphere and heated to an annealing temperature to produce a bright annealed stainless steel strip. In a preferred embodiment, the bright annealed stainless steel strip is fed directly to an electrolytic treatment tank containing an electrolyte solution for treating, cleaning and removing scale from the surface of the bright annealed stainless steel strip. In alternative embodiments, the bright annealed stainless steel strip can be transferred to a storage facility and later passed through the electrolytic treatment tank.

The electrolytic treatment tank can be a conventional treatment tank having a dimension sufficient to contain an electrolyte for treating the surface of the stainless steel strip for sufficient time to effectively treat and clean the stainless steel strip. Typically, the bright annealed stainless steel strip is continuously passed through the electrolyte solution in the electrolytic treatment tank. Typically, the electrolytic treatment tank treats the stainless steel strip material by an indirect electrolysis method. The treatment tank contains an electrolyte solution and a cathode and anode positioned adjacent the surface of the strip material as known in the art. Several anodes and cathodes are spaced apart along the working length of the electrolytic tank and are spaced close to the stainless steel strip material passing through the electrolyte solution. An electric current is applied between the cathode and anode to electrolytically treat the surface of the bright annealed stainless steel strip. The stainless steel strip acts as an indirect cathode when it is positioned close to the anode and acts as an indirect anode when it is close to the cathode. The strip undergoes cathode treatment and anode treatment alternately as it passes through the electrolyte solution. Electrodes can be positioned on each side of the strip material to effectively treat both sides of the strip material.

The process of the invention subjects the bright annealed stainless steel strip material to electrolytic cleaning in an electrolyte solution at a current density of up to about 200 A/dm$^2$. Preferably, the bright annealed stainless steel strip material is subjected to a current density of about 20 A/dm$^2$ to about 200 A/dm$^2$. It has been found that treating the bright annealed stainless steel strip material at the high current density effectively removes scale, impurities and other materials from the surface of the bright annealed stainless steel strip. In addition, the high current densities produce a polished electro-chemically treated surface and an enhanced cleaning effect on the scale and surface materials depending on the pH of the electrolyte solution.

The electrolyte solution includes an effective amount of sulfate ions to effectively polish and clean the scale from the surface of the bright annealed stainless steel strip material. The sulfate ions can be provided from a suitable source such as, for example, sulfuric acid, alkali metal sulfates, alkaline earth metal sulfates or ammonia sulfate. In further embodiments, the electrolyte solution can include anions selected from the group consisting of phosphates, sulfates, fluorides, nitrates, chlorides, and mixtures thereof. In preferred embodiments, the electrolyte contains sulfate ions since the sulfates have been found to be effective in treating the bright annealed stainless steel strip to clean and remove scale and other hard deposits from the surface of the stainless steel. In addition, the electrolytic treatment using an electrolyte solution containing sulfate ions can be optimized to improve the removal rate of the deposits on the surface of the steel and decrease the roughness of the surface to improve the surface brightness of the stainless steel. In addition, sulfate electrolyte solutions do not interference with the anode material such as lead or silicon casting in the electrolytic treatment tank. An oxidizing agent or reducing agent can be added to the electrolyte solution to adjust the redox potential to a desired value. In one embodiment, the redox potential is adjusted to about 860 mV. In one embodiment of the invention, the electrolyte solution contains sodium sulfate or sulfuric acid substantially in the absence of nitric acid.

In a first embodiment of the invention, the electrolyte solution is an aqueous sodium sulfate solution containing an amount of sodium sulfate effective to polish and clean the bright annealed stainless steel strip. The concentration of the sodium sulfate can vary depending on the current density, the extent of the scale layer, the temperature of the electrolyte solution and the pH. Typically, the electrolyte solution contains about 10 wt % to about 30 wt % sodium sulfate. The electrolyte solution contain sulfate ions is generally maintained at a temperature of about 20° C. to about 95° C. and at a pH 4 to about pH 12. The electric current is applied to the electrolyte solution at a current density of about 5 A/dm$^2$ to about 100 A/dm$^2$. The electric current is also applied to provide a charge density of about 100 C/dm$^2$ to about 3000 C/dm$^2$.

In the embodiment where the electrolyte solution contains sodium sulfate, the solution is preferably maintained at a pH of about pH 4 to about pH 12, and preferably about pH 7 to about pH 12. In one preferred embodiment of the invention, the pH of the sodium sulfate electrolyte solution is about pH 7. It has been found that the sodium sulfate electrolyte at a pH of less than about pH 7 provide high removal rates of the scale and surface materials on the bright annealed stainless steel strip material. At neutral and alkaline pH, the sodium sulfate electrolyte solution provides an electro-polishing effect that is able to effectively remove the hard deposits and impurities on the surface of the bright annealed stainless steel strip. The higher pH of the sodium sulfate solution is also found to enhance the degree of brightness on the surface of the bright annealed stainless steel strip.

The sodium sulfate electrolyte solution is typically maintained at a temperature between about 30° C. and about 95° C. In a preferred embodiment of the invention, the sodium sulfate electrolyte solution is maintained at a temperature of about 85° C. Adjusting the temperature of the sodium sulfate electrolyte solution to a predetermined temperature allows the electrolyte solution to be adjusted to a desired pH value. For example, the pH can be adjusted to have a pH less than about 7 to enhance the rate of removal of the hard deposits and scale from the stainless steel. Alternatively, the pH can be adjusted to neutral or alkaline to improve the electrolytic polishing effect of the electrolyte solution and the electrolytic process.

An electric current is applied to the electrolyte solution in the electrolytic treatment bath from a power source as known in the art. The electric current is typically applied to provide a charge density between about 100 C/dm$^2$ and about 3000 C/dm$^2$. In a preferred embodiment, the sodium sulfate electrolyte solution is subjected to a charge density of about 500 C/dm$^2$.

The current density applied to the sodium sulfate electrolyte solution can be up to about 200 A/dm$^2$. Typically, the current density is applied at about 20 A/dm$^2$ to about 200 A/dm$^2$, and preferably about 50 A/dm$^2$ to about 200 A/dm$^2$. The current density is selected depending on the electrolyte solution and the desired surface property of the bright annealed stainless steel strip. The current density is also selected in relation to the pH of the electrolyte solution, the temperature and specific anions in the electrolyte solution. For example, a sodium sulfate solution at about pH 7 and a current density of about 50 A/dm$^2$ provide an effective electrolytic polishing effect on the bright annealed stainless steel surface. The electric current is applied for a sufficient time to achieve the desired degree of cleaning and brightness level of the stainless steel strip. Typically, the longer treatment at a greater charge density produces a greater degree of brightness and cleaning of the surface of the bright annealed stainless steel strip.

In another embodiment of the invention, the electrolyte solution is a sulfuric acid solution having a sulfuric acid concentration sufficient to effectively remove the hard deposits and scale from the bright annealed stainless steel surface. Preferably, the electrolyte solution contains sulfuric acid having a free acid concentration of at least about 5 g/l. The temperature of the sulfuric electrolyte solution is typically maintained at about 20° C. to about 95° C. The electric current is applied to the electrolyte to provide a charge density of about 100 C/dm$^2$ to about 3000 C/dm$^2$. In a preferred embodiment, the electric current is applied to provide a charge density of about 150 C/dm$^2$. The current density is typically applied at about 5 A/dm$^2$ to about 100 A/dm$^2$. In a preferred embodiment, the current density is applied at about 30 A/dm$^2$.

It has been found that a sulfuric acid electrolyte solution having a free acid concentration of at least about 5 g/l provides a relatively high rate of removal of the hard deposits and scale from the bright annealed stainless steel strip. In a preferred embodiment, the sulfuric acid electrolyte solution is supplied with an electric current at a current density of about 30 A/dm$^2$.

In a further embodiment of the invention, the electrolyte solution is a sulfuric acid solution having a free acid concentration of at least about 5 g/l and is adjusted to have a redox potential of about 860 mV. The redox potential is adjusted in the sulfuric acid solution by the addition of various reducing agents and oxidants as known in the art. Suitable agents for adjusting the redox potential can be various metal ions and oxidants. A preferred method of adjusting the redox potential is by the addition of chromate ions ($Cr^{6+}$). It has been found that the sulfuric acid electrolyte having the redox potential adjusted to about 860 mV provides high rates of removal of the scale and hard deposits from the bright annealed stainless steel surface without significantly reducing the brightness levels of the surface of the stainless steel.

Typically, the sulfuric acid electrolyte solution containing the redox potential adjusting agents are maintained at a temperature of about 20° C. to about 95° C., and preferably about 50° C. The charge density is generally applied at about 100 C/dm$^2$ to about 3000 C/dm$^2$, and preferably about 350 C/dm$^2$ to about 3000 C/dm$^2$ and more preferably about 350 C/dm$^2$.

The electric current is supplied to the sulfuric acid electrolyte at a current density of about 5 A/dm$^2$ to about 100 A/dm$^2$, and preferably about 40 A/dm$^2$ to about 100 A/dm$^2$. In embodiments of the invention, the electrolyte solution has a pH of about 7 and a current density is applied of about 50 A/dm$^2$. This pH and current density provide an enhanced electrolytic polishing effect to the bright annealed stainless steel surface. The treatment time in the electrolyte solution is determined by the degree of brightness desired. Typically, the longer treatment times improve the brightness of the resulting stainless steel strip. The extremely high charge density has the advantage of providing a high degree of brightness to the surface of a bright annealed stainless steel surface having an initial poor quality surface.

The electrolyte solution generally contains an active electrolyte compound, such as sodium sulfate or hydrochloric acid, dissolved metals and pH adjusting agents. A sodium sulfate electrolyte solution generally contains about 100 g/l to about 350 g/l sodium sulfate, and preferably about 150 g/l at about 20° C. A sodium sulfate solution containing about 150 g/l sodium sulfate at room temperature is desirable to avoid precipitation of the sodium sulfate. Lower concentrations of sodium sulfate can cause a higher voltage drop on the rectifiers of the circuit, thereby increasing energy costs.

The dissolved metals in the electrolyte solution primarily include iron, chromium and nickel. Preferably, the chromium is hexavalent chromium ($Cr^{6+}$) in solution as chromic acid. Preferably, the $Cr^{6+}$ concentration is at least 1 g/l, and more preferably about 5 g/l to about 10 g/l. Higher concentration of $Cr^{6+}$ can be used, but are generally avoided due to the toxic nature of the chromium. The other metals are usually present as metal hydroxides.

The pH adjusting agents are typically sodium hydroxide, sodium carbonate, or sulfuric acid. A preferred pH for the sodium sulfate electrolyte is about pH 3.5 to pH 7. A pH below about pH 3.5 is generally not desirable because the chromium as $Cr^{6+}$ and $Cr^{3+}$ can deposit on the strip when the strip is cathodic. Acidic electrolyte solutions provide a stronger cleaning effect, higher attack on the base metal, rounder surfaces and lower brightness of the stainless steel. The acidic electrolyte solutions require free sulfuric acid in solution to prevent the deposition of $Cr^{3+}$. The $Cr^{6+}$ is added separately as a neutral electrolyte or other source. The $Cr^{6+}$ serves as an oxidizing agent and converts $Fe^{2+}$ to $Fe^{3+}$ and increases the redox potential.

Sodium hydroxide is added as a pH adjusting agent when an alkaline electrolyte is desired. Generally, the alkaline pH is between about pH 7 and pH 12, and preferably about pH 10 to pH 11. The alkaline electrolyte produces a brighter surface on the stainless steel.

As part of the tests for pickling of stainless steel with the electro-chemical pickling process, tests were conducted in treating the bright annealed stainless steel material in this way. Here various electrolytes were tested under various operating conditions. The principal data for the individual electrolytes are summarized in the following test examples.

The surface properties (degree of brightness, color) are often the top priority with bright annealed stainless steel material. Therefore, the tests were conducted to establish the extent to which the degrees of brightness (roughness) can be influenced by various electrolyte settings (pH-value, temperature, redox potential).

The following non-limiting examples demonstrate the advantages of the process of the invention.

EXAMPLE 1

A bright annealed stainless steel strip material obtained from a bright-annealing furnace was treated with sulfuric acid electrolyte in an electrolytic treatment tank. The electrolyte solution had a composition of $H_2SO_4$=50 g/l, $Fe^{2+}$=7 g/l, $Fe^{3+}$=7 g/l, T=70° C., redox potential=480 mV. The brightness figures at 60° dropped from 400 to 330 after treatment with a charge density of up to 1000 C/dm$^2$.

The brightness was measured with a REFO 3-D (reflectometer supplied by the Dr. Lange company). The M-mode was applied and the unit calibrated with the standard metal according to ISO 7668. The brightness measurements were taken at a measuring angle of 60°. The brightness measuring device was calibrated to the standard metal (type no. LZM 155) before each measurement series.

The standard metals are calibrated against a quartz wedge at the Bundesanstalt für Material-Prüfung (BAM) in Berlin according to ISO 7668 (20° approx. 1900, 60° approx. 800, 85° approx. 150).

The redox potential was measured in comparison with a hydrogen electrode.

EXAMPLE 2

A bright annealed stainless steel strip material was treated with redox electrolyte ($H_2SO_4$=50 g/l, $Fe^{3+}$=14 g/l, $Cr^{6+}$=1 g/l, redox potential=860 mV). The brightness values at 60° dropped from 400 to 370 following treatment with a charge density up to 1000 C/dm$^2$.

EXAMPLE 3

A bright annealed material was treated with neutral electrolyte ($Na_2SO_4$, pH=6, T=85° C.). The brightness values at 60° rose from 400 to up to 440 following treatment with a charge density up to 1000 C/dm$^2$.

Following treatment with approximately 1000 C/dm$^2$ in $Na_2SO_4$ electrolyte with a neutral pH-value, it was established by empirical tests that the deep-drawing properties of the bright annealed stainless steel material were enhanced substantially. In addition, observation through an electron microscope with a magnification of 15000 showed that the deposits initially present in trace amounts on the strip surface (probably residual oxide) were no longer visible on the surface of the electrolytically treated stainless steel.

Depth profiles were recorded by sputtering with Auger electrons. Here the following differences were observed in the composition of the layers. The intersection between oxygen and iron is roughly comparable. Oxygen penetration is much deeper in untreated samples (up to approximately 15 nm) than in treated ones (up to approximately 8 nm). The carbon concentration in untreated samples was higher than in treated ones. Following these positive preliminary tests, several coils of bright-annealed material were subjected to electro-chemical treatment on a test plant. Subsequently, two tests were conducted on the electro-chemically treated material (approximately 10 tonnes). The first test was run on the stretcher-and-roller leveling machine. The results confirmed that the softer material caused little or no damage to the rollers. The results also showed no damage from so-called micro-scratches on the stainless steel strip surface. These results are consistent with the surface analysis. In the second test, the effect of the new electro-chemical treatment on the service life of the deep-drawing tools was tested. As expected, this test showed that the electrolytic treatment has a positive effect on the service life.

Figure 1B:
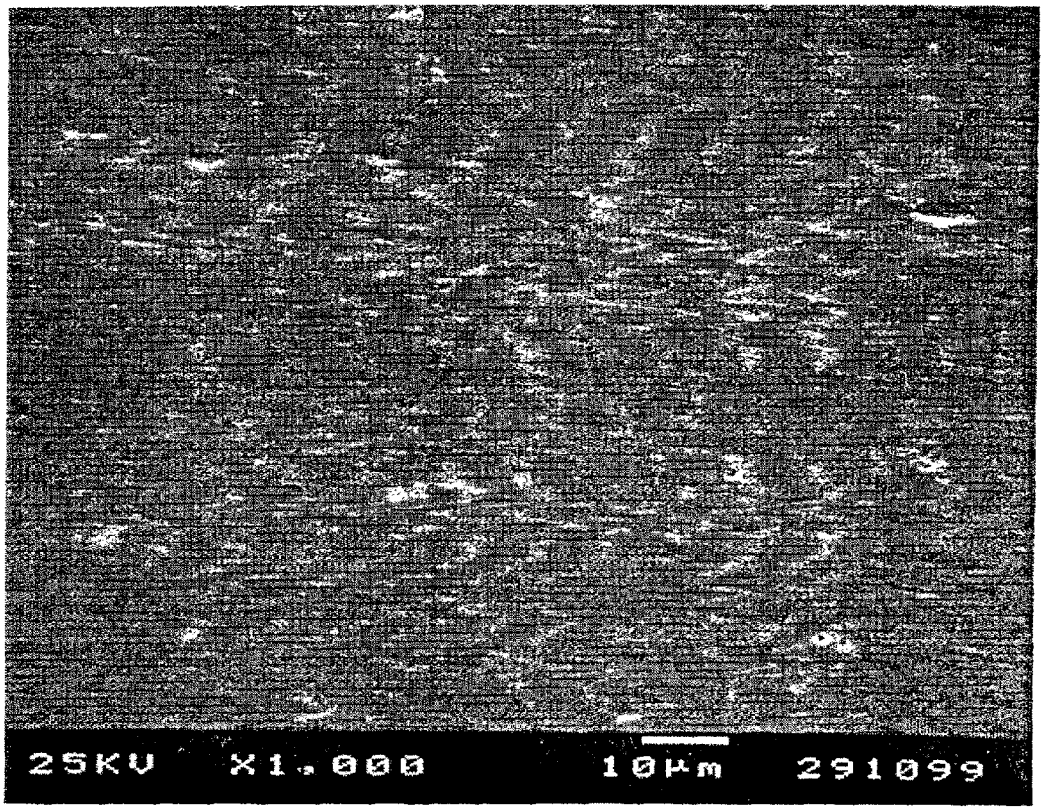
FIG. 1*b* is a surface electron microscope image of an after treatment bright annealed stainless steel article.

The photographs in FIGS. 1*a* and 1*b* show SEM (surface electron microscope) images magnified 1,000 times of the bright annealed stainless steel samples. FIG. 1*a* shows the bright annealed stainless steel surface before the electro-chemical treatment. The electro-chemical treatment was applied with a current density of 70 A/dm$^2$, at a temperature of 85° C., and a charge density of 500 C/dm$^2$. FIG. 1*b* shows the surface of the control sample after the electro-chemical treatment.

Figure 2A:
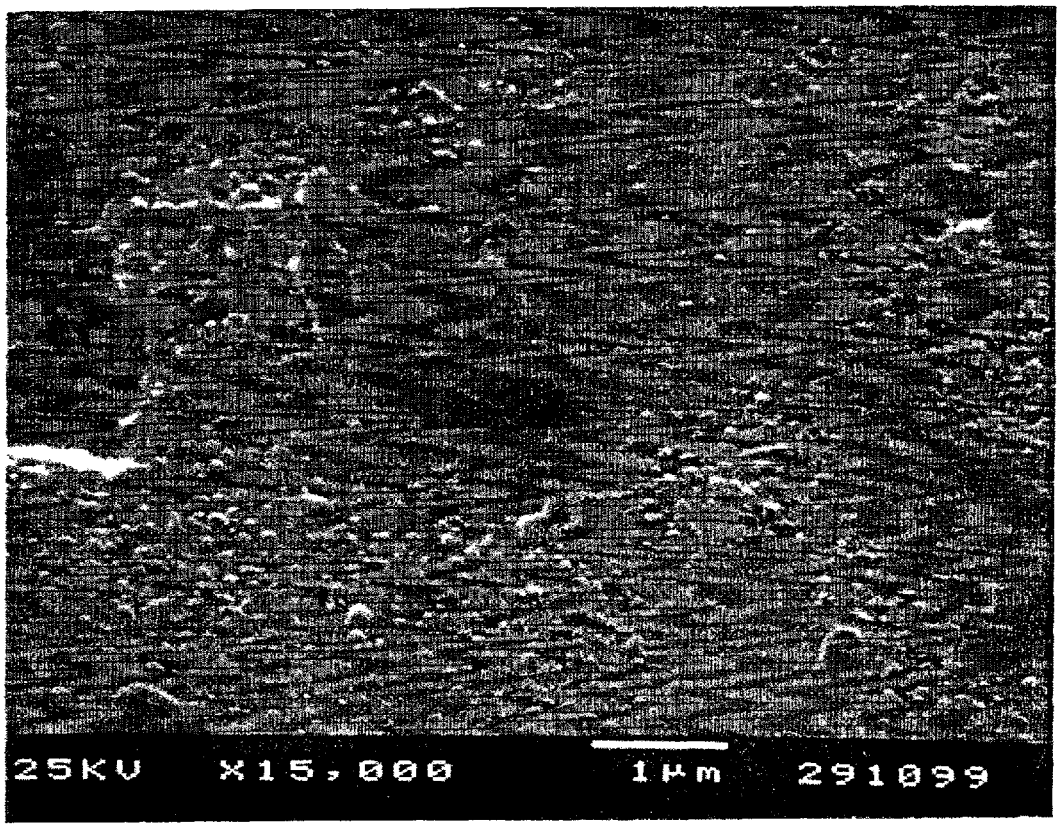
FIG. 2*a* is a magnified image of FIG. 1*a*.
Figure 2B:
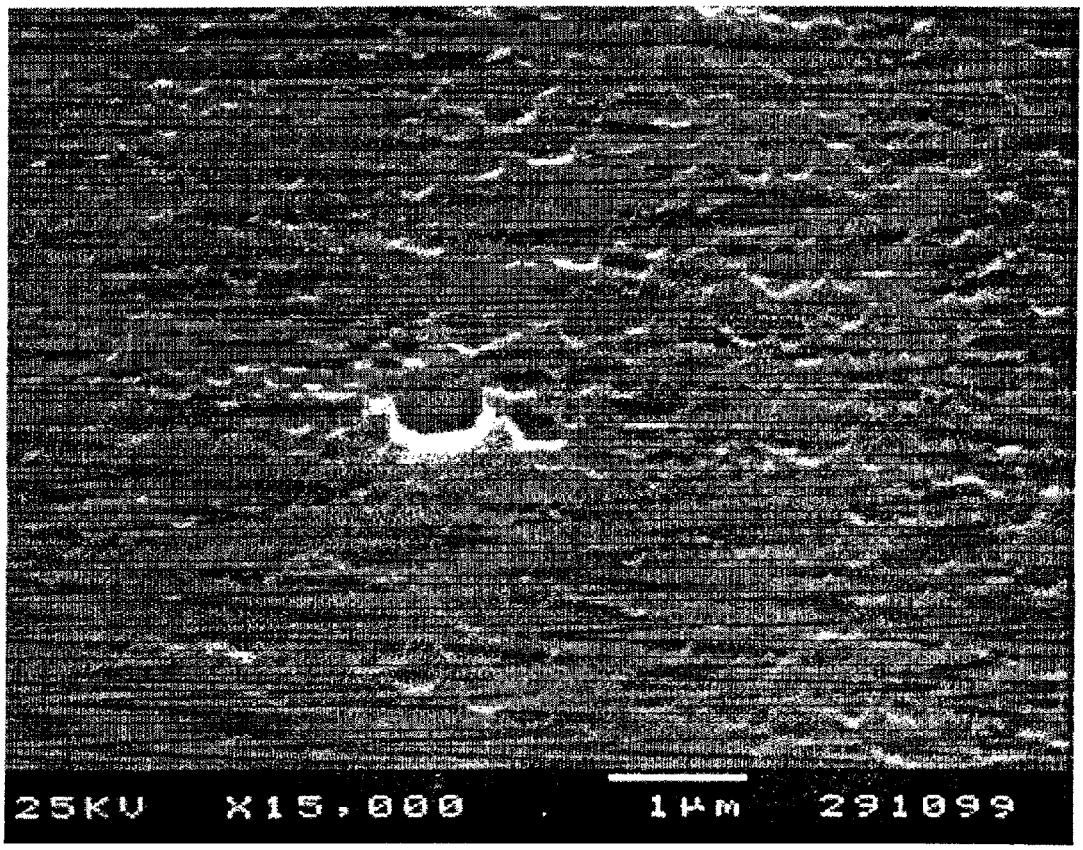
FIG. 2*b* is a magnified image of FIG. 1*b*.

The photographs in FIGS. 2*a* and 2*b* show the same images of FIGS. 1*a* and 1*b*, respectively, magnified 15,000 times. These photographs clearly show that the particles are no longer visible on the strip after the electrolytic treatment.

In all tests, the deep-drawing properties were improved. With the slightly roughened samples (Examples 1 and 2), an improved adherence of oil was obtained compared to the untreated control sample.

Thus, the process makes it possible to influence the chemical composition of the scale and materials on bright annealed strip and to control the physical properties of the strip surface of the stainless steel material in such a way that the subsequent mechanical treatment stages are considerably easier to implement with improved working properties and longer tool service life.

While several embodiments of the invention have been discussed herein, it will be appreciated that various additions and modifications can be made without departing from the scope of the invention as defined in the appended claims.

What is claimed is:

1. A process for producing a stainless steel article having improved surface properties, comprising the steps of:

annealing a stainless steel article in a bright annealing furnace in the presence of a bright annealing atmosphere at a temperature and for sufficient time to produce a bright annealed finish on said article; and thereafter treating said stainless steel article in an electrolyte solution and applying an electric current to said electrolyte solution at a current density of up to about 200 A/dm$^2$.

2. The process of claim 1, wherein said electrolyte solution contains sulfate ($SO_4^{2-}$) ions.

3. The process of claim 1, wherein said electrolyte solution contains $Na_2SO_4$ and has a pH between about 4 and about 12.

4. The process of claim 3, wherein said electrolyte solution has a pH of about 7.

5. The process of claim 3, wherein said electrolyte solution is at a temperature between about 30° C. and about 95° C.

6. The process of claim 5, wherein said electrolyte solution is at a temperature of about 85° C.

7. The process of claim 3, comprising treating said stainless steel article at a charge density between about 100 C/dm$^2$ and about 3000 C/dm$^2$.

8. The process of claim 7, comprising treating said stainless steel article at a charge density of about 500 C/dm$^2$.

9. The process of claim 3, comprising applying said electric current at a density between about 20 A/dm$^2$ and about 200 A/dm$^2$.

10. The process of claim 3, comprising applying said electric current at a density of about 50 A/dm$^2$.

11. The process of claim 1, wherein said electrolyte solution comprises sulfuric acid and has a free acid concentration of at least 5 g/l.

12. The process of claim 11, wherein said electrolyte solution has a redox potential of about 860 mV.

13. The process of claim 12, comprising the step of adding at least one compound to maintain a redox potential of about 860 mV.

14. The process of claim 12, comprising the step of adding a metal ion or oxidant to electrolyte solution to maintain a redox potential of about 860 mV.

15. The process of claim 12, comprising the step of adding chromate ions to said electrolyte solution to maintain a redox potential of about 860 mV.

16. The process of claim 11, wherein said electrolyte solution is at a temperature between about 20° C. and about 95° C.

17. The process of claim 16, wherein said electrolyte solution is at a temperature of about 50° C.

18. The process of claim 11, comprising the step of applying said electric current at a charge density between about 100 C/dm$^2$ and about 3000 C/dm$^2$.

19. The process of claim 18, comprising the step of applying said electric current at a charge density of about 350 C/dm$^2$.

20. The process of claim 11, comprising applying said current at a current density between about 5 A/dm$^2$ and about 100 A/dm$^2$.

21. The process of claim 20, comprising applying said current at a current density of about 40 A/dm$^2$.

22. The process of claim 1, wherein said electrolyte solution contains an anion selected from the group consisting of phosphate, sulfate, fluoride, nitrate, chloride, and mixtures thereof.

23. The process of claim 1, wherein said electrolyte solution comprises a solution selected from the group consisting of alkali sulfate, alkaline earth metal sulfate, and ammonium sulfate.

24. A process of producing a stainless steel article having improved surface properties, said process comprising the steps of:

annealing a stainless steel article in a bright annealing furnace in the presence of a bright annealing atmosphere at a temperature and for sufficient time to produce a bright annealed surface on said article; and thereafter electro-chemically treating said article in a sulfuric acid electrolyte solution at a current density of up to about 200 A/dm$^2$.

25. The process of claim 24, wherein said process comprises applying an electric current to said electrolyte solution at a charge density between about 100 C/dm$^2$ and about 3000 C/dm$^2$ and a current density between about 5 A/dm$^2$ and about 100 A/dm$^2$.

26. The process of claim 25, wherein said sulfuric acid electrolyte contains at least 5 g/l free acid and has a redox potential of about 860 mV.

27. A process for producing a stainless steel article comprising:

annealing a stainless steel article in a bright annealing furnace in the presence of a bright annealing atmosphere at a temperature and for a time to produce a bright annealed surface on said article; and thereafter electro-chemically treating said bright annealed surface in a sodium sulfate electrolyte by applying an electric current at a current density of about 20 A/dm$^2$ to about 200 A/dm$^2$ and a charge density of about 100 C/dm$^2$ to about 3000 C/dm$^2$.

28. The process of claim 27, wherein said electrolyte solution has a pH between about 4 and about pH 12.

29. The process of claim 28, wherein said electrolyte solution has a pH of about pH 7 to about pH 12 and said electrolytic treatment comprises enhancing the brightness of said surface of said article.

30. A process for producing a stainless steel article having improved surface properties, comprising the steps of:

annealing a stainless steel article in a bright annealing hydrogen atmosphere at a temperature of about 800° C. to about 1100° C. for sufficient time to produce a bright annealed finish on said article; and thereafter treating said stainless steel article in an electrolyte solution and applying an electric current to said electrolyte solution at a current density of up to about 200 A/dm$^2$.

31. A process of producing a stainless steel article having improved surface properties, said process comprising the steps of:

annealing a stainless steel article in a hydrogen atmosphere at a temperature of about 800° C. to about 1100° C. in a bright annealing furnace for sufficient time to produce a bright annealed surface on said article; and thereafter electro-chemically treating said article in a sulfuric acid electrolyte solution at a current density of up to about 200 A/dm$^2$.

32. A process for producing a stainless steel article comprising:

annealing a stainless steel article in a hydrogen atmosphere at a temperature of about 800° C. to about 1100° C. in a bright annealing furnace for a time to produce a bright annealed surface on said article; and thereafter electro-chemically treating said bright annealed surface in a sodium sulfate electrolyte by applying an electric current at a current density of about 20 A/dm$^2$ to about 200 A/dm$^2$ and a charge density of about 100 C/dm$^2$ to about 3000 C/dm$^2$.

* * * * *